US007240738B2

(12) United States Patent
Pendleton

(10) Patent No.: US 7,240,738 B2
(45) Date of Patent: Jul. 10, 2007

(54) SELF-ORIENTING SELECTABLE LOCATING COLLET AND METHOD FOR LOCATION WITHIN A WELLBORE

(75) Inventor: Bryan P. Pendleton, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 37 days.

(21) Appl. No.: 10/763,757

(22) Filed: Jan. 22, 2004

(65) Prior Publication Data

US 2004/0149452 A1 Aug. 5, 2004

Related U.S. Application Data

(60) Provisional application No. 60/443,434, filed on Jan. 28, 2003.

(51) Int. Cl.
*E21B 23/01* (2006.01)

(52) U.S. Cl. ..... 166/382; 166/117.5; 166/208; 166/240; 166/255.2

(58) Field of Classification Search ..... None
See application file for complete search history.

(56) References Cited

U.S. PATENT DOCUMENTS

| | | | | |
|---|---|---|---|---|
| 2,901,045 | A | 8/1959 | Schramm | 166/125 |
| 3,888,306 | A | 6/1975 | Wetzek | 166/255 |
| 3,934,648 | A * | 1/1976 | Amancharla et al. | 166/116 |
| 4,077,472 | A * | 3/1978 | Gano | 166/382 |
| 4,236,734 | A * | 12/1980 | Ahangarzadeh | 285/26 |
| 4,840,229 | A | 6/1989 | Proctor et al. | 166/381 |
| 5,092,402 | A | 3/1992 | Perricone et al. | 166/113 |
| 6,003,599 | A | 12/1999 | Huber et al. | 166/255.2 |
| 6,012,527 | A | 1/2000 | Nitis et al. | 166/313 |
| 6,082,453 | A | 7/2000 | Bakke | 166/240 |
| 6,142,225 | A * | 11/2000 | McCorry et al. | 166/117.6 |
| 6,209,635 | B1 * | 4/2001 | Gotlib et al. | 166/117.5 |
| 6,510,898 | B1 | 1/2003 | Buytaert | 166/381 |

FOREIGN PATENT DOCUMENTS

| | | |
|---|---|---|
| GB | 956 191 A | 4/1964 |

OTHER PUBLICATIONS

PCT International Search Report dated Jul. 16, 2004.

* cited by examiner

*Primary Examiner*—Zakiya W. Bates
(74) *Attorney, Agent, or Firm*—Cantor Colburn LLP

(57) ABSTRACT

A self orienting selectable locating collet including a collet having at least one deflectable finger; an orientation key positioned at the deflectable finger and being deflectable with the finger; and a collet profile disposed at an outside dimension of the collet. A method is also included.

26 Claims, 4 Drawing Sheets

SELF-ORIENTING SELECTABLE LOCATING COLLET AND METHOD FOR LOCATION WITHIN A WELLBORE

CROSS REFERENCE TO RELATED APPLICATIONS

This application claims the benefit of an earlier filing date from U.S. Provisional Application Ser. No. 60/443,434 filed Jan. 28, 2003, the entire disclosure of which is incorporated herein by reference.

BACKGROUND

Oil field operations often include the delivery of devices to the downhole environment from initial completions through reentry long after completions are installed and at all times in between. Entries to the downhole environment often need to be oriented and positively located to ensure the purpose of the entry can be properly carried out. Measurement while drilling, casing collar locators, seismic devices, selective profiles for dogs or collets and orientation profiles have all been employed to assist in positive location but in each case several tools and potentially additional runs have been necessary to achieve the desired result.

SUMMARY

Disclosed herein is a self orienting selectable collet having at least one deflectable finger, an orientation key positioned at the deflectable finger and a collet profile disposed at an outside dimension of the collet.

Further disclosed herein is a system for downhole selective orientation of a collet. An orientation profile is provided which is installable in a downhole environment. The orientation profile includes a matchable profile therein. A collet, which can be used in the orientation profile in the orientation profile has at least one deflectable finger and an orientation key positioned at the deflectable finger. A collet profile is disposed at an outside dimension of the collet, the profile being selectively matchable to the matchable profile of the orientation profile.

Still further disclosed herein is a wellbore configured for self orienting and selective locating of collets. The wellbore includes a liner or tubing string having at least two orientation profiles therein, each having a distinct matchable profile. A collet is runnable in the borehole, which collet has a collet profile complementary to one of the matchable profile in the at least two orientation profiles.

Also disclosed herein is a method for promoting self orientation and selective location of collets in a wellbore. The method includes installing in a liner, at least two orientation profiles having selective matching profiles, running a collet having a deflectable orientation key and a collet profile thereon complementary to one of the at least two orientation profile matching profiles and orienting the collet by driving the key against said orientation profile and engaging the matching profile where complementary to the collet profile.

BRIEF DESCRIPTION OF THE DRAWINGS

Referring now to the drawings wherein like elements are numbered alike in the several Figures.

DETAILED DESCRIPTION

Figure 1:
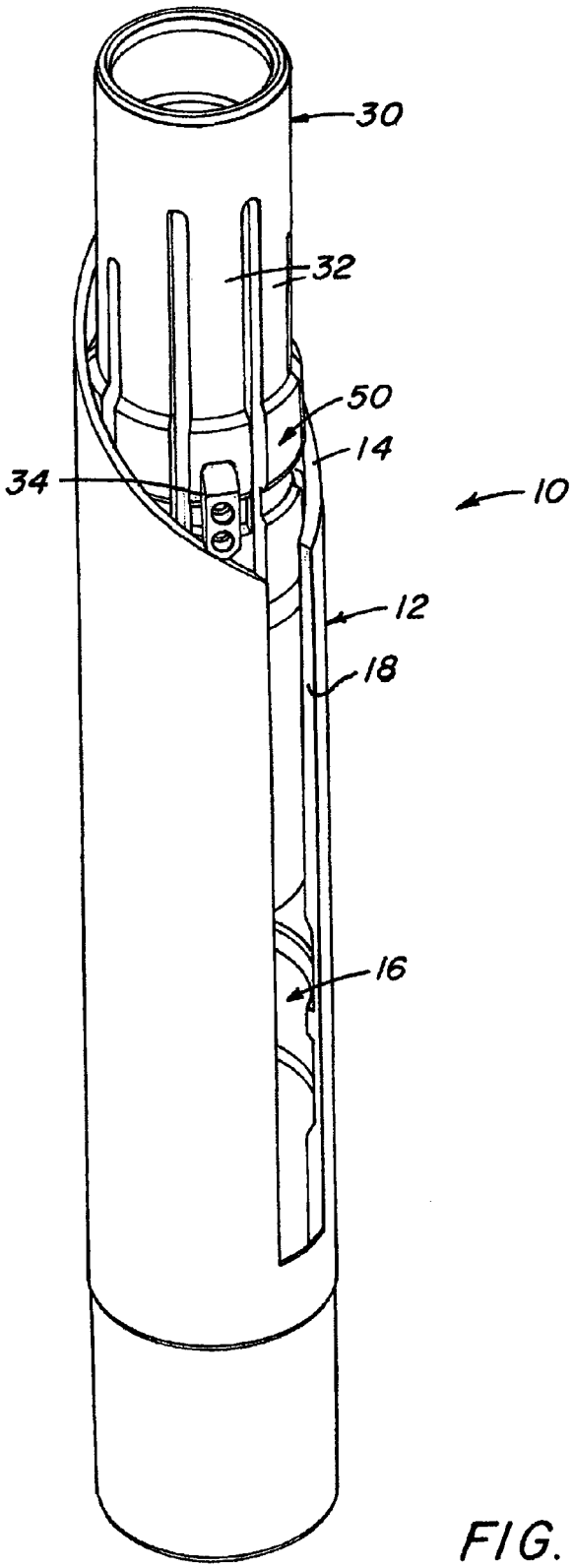
FIG. 1 is a perspective view of a self orienting and locating collet system.

Referring to FIG. 1, an overview of an embodiment as disclosed herein is illustrated. The perspective view of FIG. 1 provides a frame of reference and an understanding of the concept disclosed in more detail hereunder. The self orienting and locating collet system 10 comprises two major components. These are an orienting profile 12 whether it be an independent structure or simply a structure appurtenant another structure of the wellbore, which in this embodiment is at the lateral liner hanger, and a collet 30. Orientation profile 12 includes in general terms an orienting land surface 14, which may be helical (as illustrated or other angled surfaces), and a matchable profile 16 with which a complementary collet profile will engage. Collet 30 includes at least one and in this embodiment eight deflectable fingers 32. Disposed at one of the fingers 32 is key 34 for engaging surface 14 of orienting profile 12 to orient collet 30. Collet profile 50 is of a complementary shape to a specific matchable profile 16.

Running collet 30 in a specific orientation profile where the matchable profile is complementary causes the collet to orient and then engage the matchable profile. The engagement may be load bearing if desired. Where the collet profile and matchable profile are not complementary, the key causes the collet to orient and when the profiles do not engage the key 34 is deflected and the collet 30 passes through the orientation profile.

Figure 2:
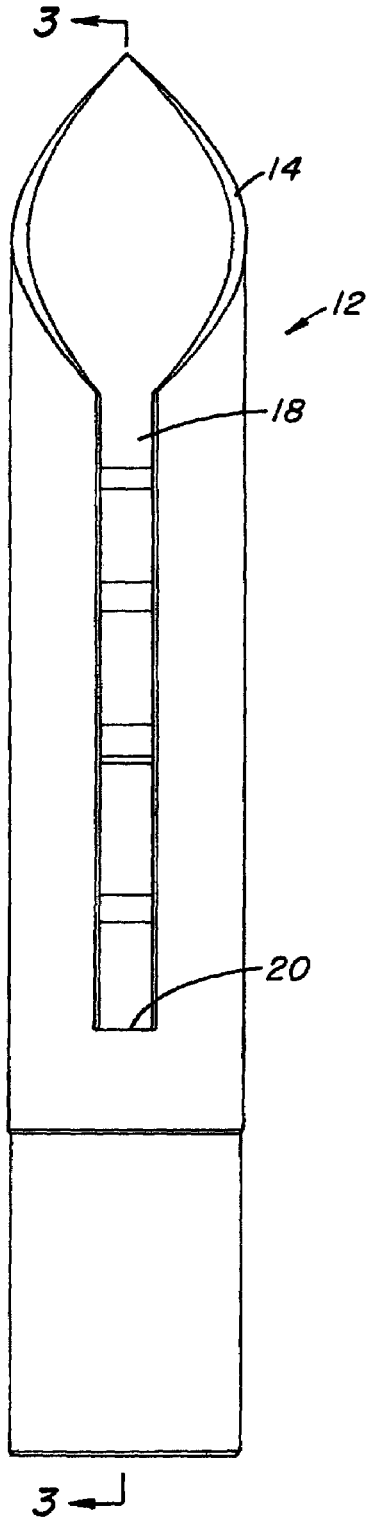
FIG. 2 is a side plan view of an orientation profile.

Referring now to FIG. 2, this embodiment of the orientation profile 12 is addressed in greater detail. Orientation profile 12 is illustrated as having a helical edge surface 14 that is intended to be facing uphole or downhole depending on application. Those of skill in the art will recognize that an uphole facing configuration is more common, but that a downhole facing configuration is possible. Further illustrated is an opening 18 in the form of a slot configured to receive key 34 once key 34 has oriented collet 30. A base 20 of slot 18, is angled about 15 degrees to assist key 34 deflecting and collet 30 passing through orientation profile 12, if the collet profile 50 is not complementary to matchable profile 16.

Figure 3:
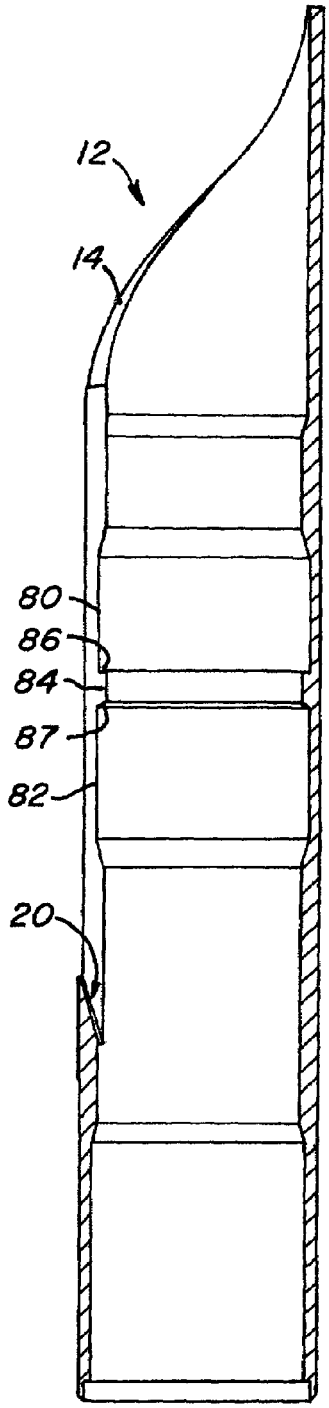
FIG. 3 is a cross-section of the orientation profile of FIG. 2 taken along section line 3—3.

Moving to FIG. 3, matchable profile 16 is visible. It is to be understood that matchable profile 16 as shown is but one configuration in an unlimited number of configurations which are possible. Many different configurations may be employed in a specific wellbore so that locations where such are positioned in the wellbore may be automatically selected by simply running a specific collet in the well.

In the embodiment illustrated, matchable profile 16 comprises two radially larger sections 80, 82. As illustrated, these sections are of different lengths. Separating section 80, 82 is ring 84 which includes a reverse cut 86 (an optional feature). Location and self-orientation will occur without benefit of the reverse cut. In this case, reverse cut 86 is positioned on an uphole end of ring 84 and is configured to hold a load in a downhole direction. In one embodiment, the reverse cut will be about 80 degrees to a longitudinal aspect of section 80.

Orientation profile 12 is located on a lateral liner or on the tubing string as illustrated and is delivered downhole. The ability to selectively install the matchable profile provides the ability to selectively locate the collet that will be run subsequently by simply selecting a collet having a collet profile that is complementary to the matchable profile put in place in the liner or the tubing in the downhole environment. Because of the helical edge surface 14 coupled with the slot base 20, all collets will be oriented to all orientation profiles but are not shouldered there and if the profiles do not match, will pass through the profile 12 to the next profile 12 to be reoriented and perhaps be complementary to that matchable profile. This will continue until a matchable profile is reached or all orientation profiles 12 are exhausted (in which case an operator error is likely since matching a profile is intended). Opposite reverse cut 86 is an inclined snap-out surface 87 whose angle is dictated by desired snap-out force which is relevant to retrieval of the collet. In the illustrated embodiment, the angle is 60°. Clearly, more or less angle can be used depending upon application. Upon snap-out the collet may be retrieved.

Figure 4:
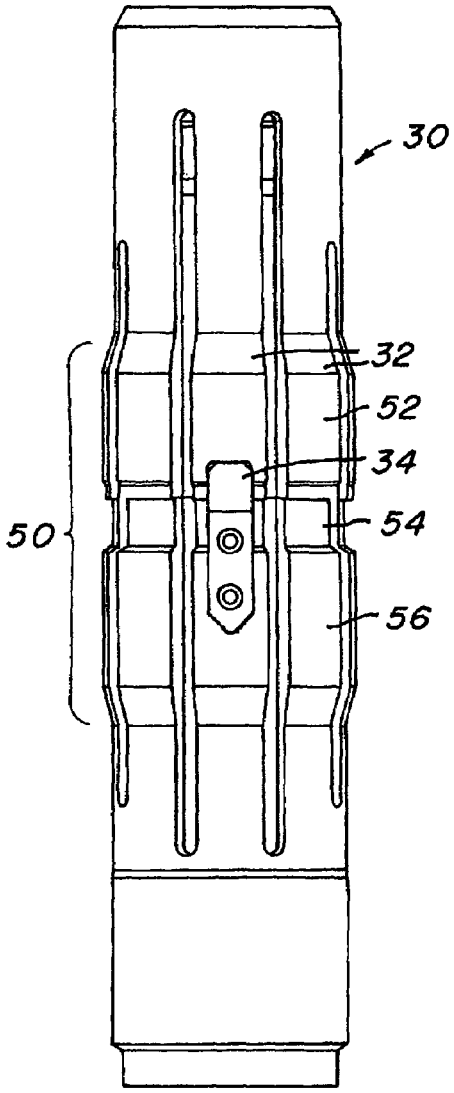
FIG. 4 is a side plan view of a collet employed in the system disclosed herein.

Referring now to FIG. 4, a collet 30 is illustrated. In this embodiment collet 30 comprises fingers 32 and key 34 as noted above. Fingers are defined by removal of material of a tubular structure as shown. It will be appreciated by those of skill in the art that the finger supporting key 34 is longer than surrounding fingers. This is due to the greater outside dimension that key 34 creates. Key 34 must be able to deflect sufficiently to fit through the orientation profiles. A longer finger allows that deflection without exceeding the elastic limit of the material of the finger. This avoids permanent deformation thereof. The fingers 32 carry the collet profile 50 which is made up of several different diameters of material such as wider section 52, narrower section 54 and larger wider section 56. From FIGS. 2 and 3, one of ordinary skill in the art will appreciate that collet profile 50 is deflected inwardly until reaching a matchable profile 16 that is complementary and expands outwardly to engage therewith. If a load is desired to be held, a surface of collet profile 50 will be configured to engage reverse cut 86.

Figure 5:
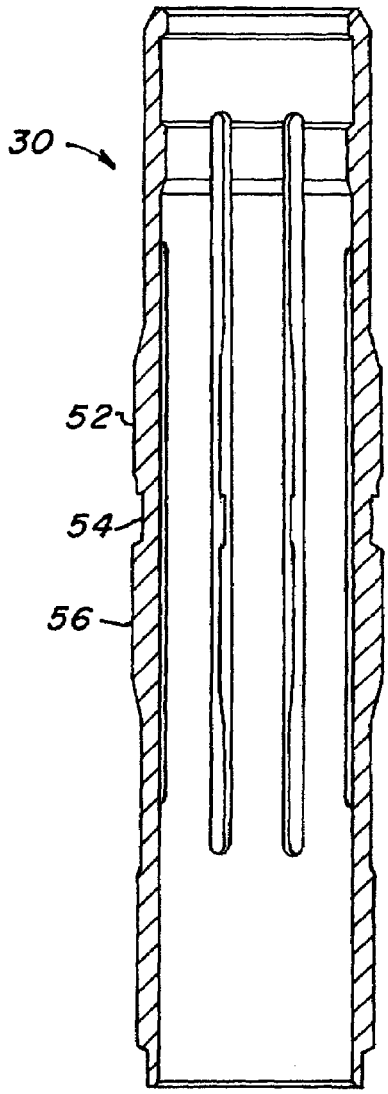
FIG. 5 is a longitudinal cross-section view of the collet illustrated in FIG. 4.
Figure 6:
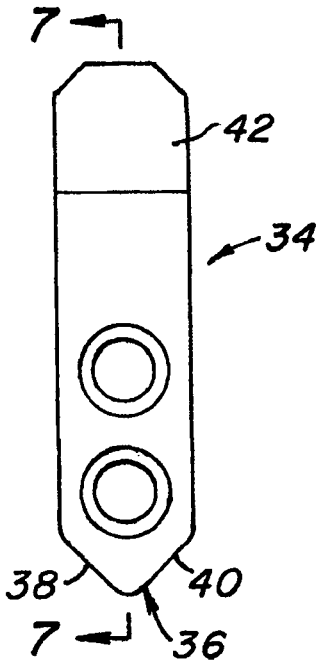
FIG. 6 is a top plan view of a key of the collet system.
Figure 7:
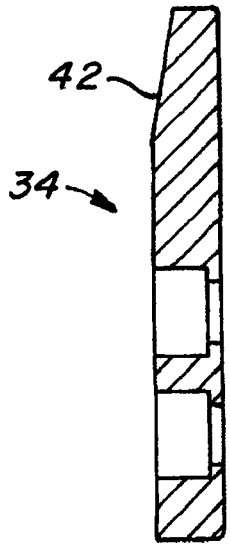
FIG. 7 is a cross-section view of FIG. 6 taken along section line 7—7 in FIG. 6.

FIG. 5 provides a cross-sectional view of FIG. 4, for clarity. Referring to FIGS. 6 and 7, the key 34 of the illustrated embodiment is shown. In FIG. 6, downhole end 36 of key 34 is shown to be angled on two sides 38 and 40. These surfaces assist key 34 in moving along helical edge 14 by helping to avoid gouging of metal. Each of the angles 38, 40 are, in one embodiment, close to an angle employed for the helical edge surface 14. Referring to FIG. 7, feature 42 is a chamfer that assists with respect to pulling back the collet if necessary. The chamfer helps the tool to slide through restrictions rather than land on them and impeded uphole motion. In specific angle of the chamfer is not critical as long as the angle is sufficient for its intended purpose. Key 34 may be machined on the tubular from which collet 30 is constructed or more commonly may be attached thereto by fasteners, adhesives, welding, etc.

It will be appreciated from the foregoing that multiple orientation profiles may be placed in a well and may be configured as one on each lateral liner. A substantial benefit of the disclosed system is that the inner dimension of each is the same. That is, distinct orientation profiles need not have progressively smaller inside diameters as is the case in the prior art. This allows for the wellbore to have orientation profiles while maintaining the inside diameter throughout. The reverse cut 86 provides a no-go configuration which negates the need to have a different inner dimension otherwise needed for a positive no-go condition.

While preferred embodiments have been shown and described, various modifications and substitutions may be made thereto without departing from the spirit and scope of the invention. Accordingly, it is to be understood that the present invention has been described by way of illustration and not limitation.

What is claimed:

1. A self orienting selectable locating collet comprising:
a collet having at least one deflectable finger;
an orientation key positioned at said deflectable finger and deflectable with said finger;
a collet profile disposed at an outside dimension of said collet.

2. A self orienting selectable locating collet as claimed in claim 1 wherein said key includes surfaces configured to engage an orientation profile and orient said collet and to pass through said orientation profile after orienting.

3. A self orienting selectable locating collet as claimed in claim 1 wherein said collet profile is selective to a specific orientation matchable profile.

4. A self orienting selectable locating collet as claimed in claim 1 wherein said collet profile includes a reverse cut enabling said collet profile to carry a load.

5. A self orienting selectable locating collet as claimed in claim 4 wherein said reverse cut is configured to carry a load in the downhole direction.

6. A self orienting selectable locating collet as claimed in claim 4 wherein said reverse cut is at an angle of about 80 degrees to an axis of said collet.

7. A self orienting selectable locating collet as claimed in claim 1 wherein said collet further includes a snap-out surface.

8. A self orienting selectable locating collet as claimed in claim 7 wherein said snap-out surface is inclined to facilitate the snap-out of the collet from a separate matchable profile.

9. A self orienting selectable locating collet as claimed in claim 7 wherein the snap-out surface is inclined at about 60°.

10. A system for downhole orientation and selective location of a collet comprising:
an orientation profile installable in a downhole environment;
a matchable profile in said orientation profile;
a collet having at least one deflectable finger and orientation key positioned at said deflectable finger said orientation key being deflectable with said finger; and
a collet profile disposed at an outside dimension of said collet, said profile being selectively matchable to said matchable profile.

11. A system for downhole orientation and selective location of a collet as claimed in claim 10 wherein said orientation profile includes an opening at a desired orientation to receive said key.

12. A system for downhole orientation and selective location of a collet as claimed in claim 11 wherein said opening is a slot.

13. A system for downhole orientation and selective location of a collet as claimed in claim 12 wherein said slot includes an angled edge to deflect said key for continued downhole movement of said collet.

14. A system for downhole orientation and selective location of a collet as claimed in claim 13 wherein said angled edge is at an angle of about 15 degrees.

15. A system for downhole orientation and selective location of a collet as claimed in claim 10 wherein said matchable profile and said collet profile only engage if they are complementary.

16. A system for downhole orientation and selective location of a collet as claimed in claim 10 wherein said orientation profile is an angled land surface upon which said key lands and causes rotation of said collet.

17. A system for downhole orientation and selective location of a collet as claimed in claim 16 wherein said angled land surface is helical.

18. A system for downhole orientation and selective location of a collet as claimed in claim 10 wherein said orientation profile is mounted at a lateral liner.

19. A system for downhole orientation and selective location of a collet as claimed in claim 10 wherein said orientation profile is mounted at a lateral liner hanger.

20. A wellbore configured for self orienting and selective locating of collets comprising:

a liner having at least two orientation profiles therein, each having a distinct matchable profile and defining through bores having the same internal dimension; and a collet runnable in said liner having a collet profile complementary to one of said at least two orientation profiles, said collet including an orientation key at a finger of said collet and deflectable with said finger.

21. A wellbore configured for self orienting and selective locating of collets as claimed in claim 20 wherein said orientation matchable profiles are configured to cause said collet profile to pass on if it is not a complementary profile.

22. A method for promoting self orientation and selective location of collets in a wellbore comprising:

installing in a liner, at least two orientation profiles having selective matchable profiles;

running a collet having a deflectable orientation key deflectable with a finger of said collet and a collet profile thereon complementary to one of said at least two orientation profile matchable profiles; and orienting said collet by driving said key against at least one of said at least two orientation profiles and engaging said matchable profile where complementary to said collet profile.

23. A method for promoting selective self orientation and location of collets in a wellbore as claimed in claim 22 further comprising said collet profile and collet passing through said orientation profile and matchable profile when not complementary.

24. A method for promoting selective self orientation and location of collets in a wellbore as claimed in claim 23 wherein said method further includes deflecting said orientation key when said matchable profile is not complementary.

25. A wellbore configured for self orienting and selective locating of collets comprising:

a tubing having at least two orientation profiles therein, each having a distinct matchable profile and defining through bores having the same internal dimension; and a collet having an orientation key disposed on a finger of said collet and deflectable with said finger, said collet runnable in said tubing having a collet profile complementary to one of said at least two orientation profiles.

26. A method for promoting self orientation and selective location of collets in a wellbore comprising:

installing in a tubing, at least two orientation profiles having selective matchable profiles;

running a collet having a deflectable orientation key, said key being deflectable with a finger of said collet, and a collet profile thereon complementary to one of said at least two orientation profile matchable profiles; and orienting said collet by driving said key against said orientation profile and engaging said matchable profile where complementary to said collet profile.

* * * * *